United States Patent [19]

Barmore

[11] Patent Number: 4,982,632

[45] Date of Patent: Jan. 8, 1991

[54] SOCKET WRENCH SET

[76] Inventor: Thomas C. Barmore, 4 N 127 Verrill, Addison, Ill. 60101

[21] Appl. No.: 861,991

[22] Filed: May 12, 1986

[51] Int. Cl.[5] ..... B25B 23/00

[52] U.S. Cl. ..... 81/438; 403/10; 279/83

[58] Field of Search ..... 81/437–439, 81/124.4, 124.6, 124.7, 180.1, 185, 185.2, DIG. 11; 279/1 Q, 83; 403/10, 315

[56] References Cited

U.S. PATENT DOCUMENTS

| | | | |
|---|---|---|---|
| 2,541,196 | 2/1951 | Brague | 81/438 X |
| 2,667,194 | 1/1954 | Fischer et al. | 81/438 |
| 2,878,701 | 3/1959 | Weersman | 81/438 |
| 3,255,792 | 6/1966 | Beck | 81/438 X |
| 3,588,135 | 6/1971 | Porter | 279/83 |
| 3,841,646 | 10/1974 | Bennett | 279/83 X |
| 3,850,056 | 11/1974 | Allen | 81/439 X |
| 4,084,454 | 4/1978 | Day | 81/437 X |
| 4,328,720 | 5/1982 | Shiel | 81/177.85 X |

FOREIGN PATENT DOCUMENTS

| | | | |
|---|---|---|---|
| 143122 | 5/1920 | United Kingdom | 279/83 |

*Primary Examiner*—D. S. Meislin
*Attorney, Agent, or Firm*—Paul H. Gallagher

[57] ABSTRACT

A socket having a polygonal cavity at its front end and an inner drive tool unit in the recess. The set includes a single socket and a plurality of units of different sizes, each unit including a wafer and an inner drive tool element. All the wafers have the same external dimensions, but the inner drive tool elements are of different sizes. Another form includes a plurality of units, each including a socket and an inner drive tool element, semi-fixed together.

8 Claims, 1 Drawing Sheet

SOCKET WRENCH SET

FIELD OF THE INVENTION

The invention resides in the field of socket wrench sets, wherein a series of sockets are provided for a single drive tool. The sockets are shaped and dimensioned at one end to fit the same drive tool, but are shaped and dimensioned at the other end individually to fit different size objects, such as nuts, bolt heads, etc.

OBJECTS OF THE INVENTION

A broad object of the invention is to provide a socket wrench set having the following novel features and advantages:

1. A set includes a single socket and a plurality of inner drive elements of different sizes, with consequent economy in manufacture.
2. The inner drive element when mounted in the socket is adjustable longitudinally therein.
3. A simple and very effective arrangement is provided for retaining the inner drive element in the socket against falling out.
4. A new inner drive element is provided, that not only is adapted to production in different sizes for use in a single socket of the foregoing character, but can be incorporated in a socket of such simple construction and in a simple arrangement as to provide semi-fixed socket-inner drive units of different effective sizes for selective use with a drive tool.

DESCRIPTION OF CERTAIN PREFERRED EMBODIMENTS

Referring to the invention in general, it is oriented to the basic concept of simplifying a socket wrench set to reduce the cost of manufacture thereof to a great degree. To this end the parts or elements making up the set are of extreme simplicity and of small cost of manufacture.

Figure 1:
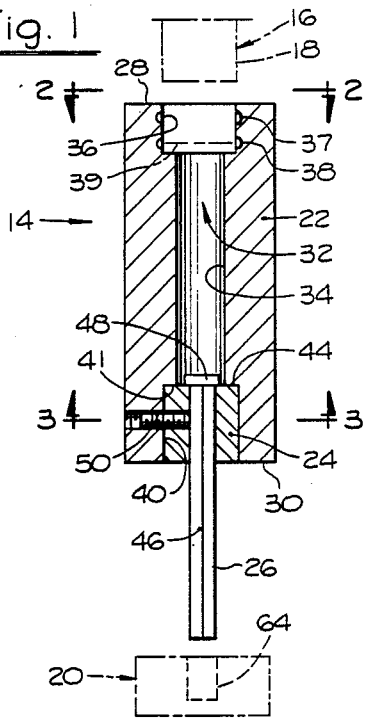
FIG. 1 is a longitudinal axial sectional view of a socket wrench unit embodying the features of the present invention.

Referring in detail to the drawings, attention is directed first to FIG. 1 showing a socket wrench unit 14 for use with a drive tool indicated generally at 16 and represented by the rotatable drive element 18 thereof. The socket wrench unit is adapted for use with, or for operating or working, a workpiece indicated generally at 20 and which may be a nut, bolt head, etc.

The socket wrench unit 14 of FIG. 1 includes a socket 22, a wafer 24, and an inner drive element 26. The wafer and inner drive element together may be referred to as a drive element unit.

Figure 2:
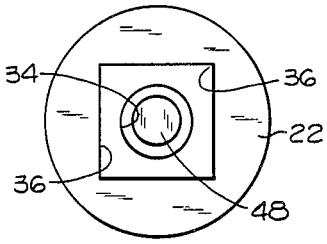
FIG. 2 is an end view taken at line 2—2 of FIG. 1.

The socket 22 is a socket member, or socket element, but generally in the trade it is known simply as a socket, and will be so referred to herein. It has a rear end 28 and a front end 30. It has a longitudinal hole 32 extending therethrough from end to end which includes a main central portion 34 which may be cylindrical in shape, and a cavity 36 at its rear end. The cavity 36 is for the reception of the element 18 of the drive tool 16, and is polygonal in shape, and complementary to the shape of the element 18 which is usually square, as shown in FIG. 2. The drive tool may be a power tool, or a rachet, or a brace.

The cavity 36 has the usual recesses 37 for receiving the holding detents in the drive tool, and similar recesses 38, spaced inwardly from the first recesses, for receiving a stopper 39 referred to again hereinbelow.

The socket has a cavity 40 in its front end polygonal in shape and preferably hexagonal (FIG. 3) for receiving the wafer 24, which is of complementary shape. The cavity 40 is larger than the main portion 34 of the hole, forming a forwardly facing shoulder 41.

The wafer 24 is fitted in the cavity 40, against the shoulder 41, and is preferably dimensioned in axial direction to be flush with the front end of the socket. The wafer 24 is provided with an axial hole 42 therethrough of polygonal shape, preferably hexagonal, to accommodate the inner drive element 26 of that shape. The hole 42 is smaller than the main central portion 34 of the hole in the socket, thus forming a rearwardly facing shoulder 44.

Figure 8:
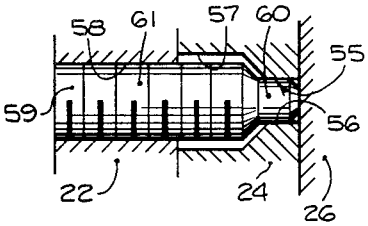
FIG. 8 is a view similar to FIGS. 6 and 7 but showing another alternate arrangement.
Figure 7:
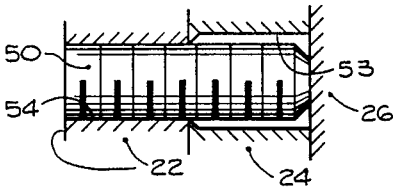
FIG. 7 is a view similar to FIG. 6, but showing the holes in adjacent parts in opposite arrangement.
Figure 9:
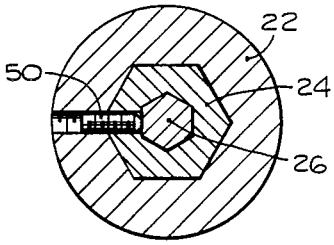
FIG. 9 is a view oriented according to FIG. 3, but showing elements in alternate positions.

The inner drive element 26 includes a main portion or body 46, in one form (FIGS. 1–5) of uniform cross sectional shape throughout its length, and includes a head 48 at one end, conveniently referred to as its rear end or its inner end. When the inner drive element 26 is fitted in the hole 42, the head 48 is engageable with the shoulder 44 and the front end or outer end extends through the hole to the exterior. The element 26 is held in the wafer by a set screw 50 threaded through aligned holes in the side walls of the socket and wafer and engaging the element. Reference is made to FIGS. 7, 8, and 9 for specific details of the set screw and its related elements.

In one form (FIG. 6) the wafer 24 is provided with a threaded hole 51 in its side wall dimensioned for engagement by the set screw while the wall of the socket 22 is provided with a hole 52 of clearance size. An alternate form is shown in FIG. 7 where the wafer is provided with a hole 53 of clearance size, while the wall of the socket 22 is provided with a hole 54 which is threaded and dimensioned for threaded engagement by the set screw.

FIG. 8 shows an additional arrangement. The wafer has a hole 55 with a reduced non-threaded portion 56 and a clearance portion 57, and the socket has a threaded hole 58. The set screw 59 has a reduced non-threaded inner end element 60 and a threaded main portion 61. The end element fits snugly in the hole 56 while the main portion is threaded in the hole 58 and has clearance in the hole portion 57.

As will be referred to again hereinbelow, the set screw 50 engages the inner drive element 26 for securing it in place. The element 26 and the set screw are made of extremely hard steel, and in order for the set screw to effectively engage, or bite into the element 26, the element 26 is provided with a plurality of recesses 62 (FIG. 4) for engagement by the set screw. Instead of the recesses, knurled or other roughened or non-planar surface may be utilized.

Figure 6:
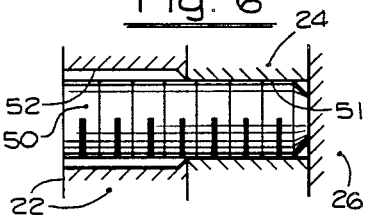
FIG. 6 is a large scale view of the set screw arrangement of FIG. 1.

A socket wrench set according to the invention includes a single socket 22, or common socket, and a plurality of units, each unit including a wafer 24 and inner drive element 26. In the use of the device, the user utilizes such a single socket 22, and selects the other elements according to the effective size desired. All of the wafers 24, which are in the shape of and resemble nuts, are of the same exterior dimensions. A number of inner drive elements 26 are provided, and as indicated above are of hexagonal shape, which is a common selected shape for the intended use. FIG. 6 shows the top view of the workpiece 20 which may be a nut or bolt head, having a recess or cavity 64 of the Allen type, which is of hexagonal shape. The inner drive element 26 is of solid construction, i.e. having no cavities therein, for fitting into such cavity or recess.

The wafers 24 of the set, while being of uniform external dimension, have holes 42 individually dimensioned for receiving the inner drive elements 26 of the size selected. In applying the drive unit to the socket, the wafer may be placed in the recess 38 first, and then the element 26 inserted from the rear end of the socket. Then the set screw is turned up against the element 26.

The element 26 may be positioned in any of a plurality of positions longitudinally, for providing adjustability. For example a very long element 26 may be utilized for inserting into confined spaces.

The element 26 alternatively can be put in the wafer by first inserting it in the wafer and then inserting the wafer, with the element 26 therein, in the cavity 38, in replacing the inner drive element. The head 48 on the inner drive element 26 prevents the latter from falling out forwardly.

The socket wrench set of the invention made according to the form described above is very inexpensive, including a single or common socket and a plurality of drive element units, each unit including the wafer and the inner drive element, with the additional advantage of the adjustability of the drive element.

Figure 3:
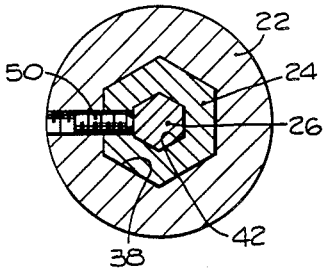
FIG. 3 is a sectional view taken at line 3—3 of FIG. 1.
Figure 5:
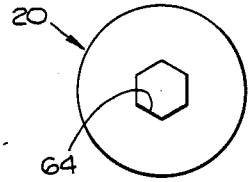
FIG. 5 is an end view of a workpiece with which the socket wrench unit is utilized.

In one form of the construction of FIGS. 1–5, and referring particularly to FIG. 3, the hexagonal wafer 24 and drive element 26 are arranged with flat side to flat side, and so that the hole through the wall of the wafer penetrates through the flat side, and the set screw engages the drive element on the flat side. It is also within the scope of the invention to stagger these elements circumferentially as represented in FIG. 9, where the element 26 is arranged with the corners thereof to the flat sides of the wafer. In this case however the hole through the wafer is introduced through a corner or point, and while this may be a more expensive step, it does provide greater point contact as between the drive element 26 and the surfaces of the cavity 40 in the socket.

Figure 10:
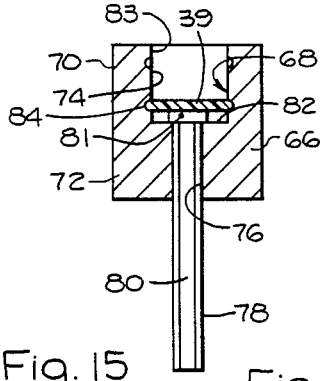
FIG. 10 is a longitudinal axial sectional view of a second form of the invention.
Figure 11:
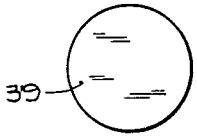
FIG. 11 is a top view of a stopper used in FIG. 10.
Figure 12:
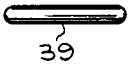
FIG. 12 is an edge view of the stopper of FIG. 11.

FIGS. 10–12 show an alternate form of drive tool elements, each mounted in an individual socket. In this form a socket 66 has a longitudinal hole 68 therethrough from the rear end 70 to the front end 72. The hole 68 includes a cavity 74 of polygonal shape (e.g. square) for receiving the rotatable element 18 of the drive tool. The hole continues with a forward reduced portion 76 of polygonal shape (hexagonal). A rearwardly facing shoulder 82 is formed in the cavity 74. The cavity has recesses 83 for receiving detents of the drive tool, and recesses 84 inwardly from the recesses 83 for receiving the edge of the stopper 39 as referred to below.

The element 78 is inserted through the cavity 74 and through the hole 76 and the head 81 butted against the shoulder 82 with the shank element 80 extending forwardly through the socket.

The inner drive element 78 is held in place by a stopper 39, identified above, which may be a piece of plastic material, relatively rigid, but at least semi-pliable. It is forced into the cavity against the head of the element 78 and high friction engagement is thereby provided against the wall of the cavity. The material of the stopper may flow into the recesses 84 and thereby provide a positive holding effect. The stopper may be forced out of its place, or removed, by applying abnormal pressure, such as against the front end of the element 78, releasing the element.

The socket and inner drive element of FIG. 10 constitutes in normal use, a single unitary element. The socket is small and very inexpensive, and the inner drive element is correspondingly inexpensive, and the combination of the two provide a unit which is of course also inexpensive. A complete set of such units of FIG. 10 may be provided and used with a single drive tool.

A stopper 39 may be utilized in connection with the socket 22 as referred to above, to prevent accidental dropping out of the element 26 in changing the latter.

Figure 13:
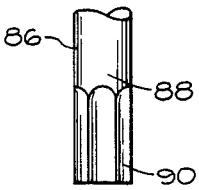
FIG. 13 is a side view of the extended end of a modified form of inner drive element.
Figure 14:
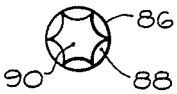
FIG. 14 is an end view from the lower end of FIG. 13.

While the inner drive elements 26, 78, are shown as uniformly hexagonal in shape thorughout their length, it is also within the scope of the invention to utilize shapes of different kinds. FIGS. 13–14 show such an inner drive element, indicated generally at 86 which has a shank including a main or central portion 88 extending from the hexagonal portion and a working end element 90. The working end element 90 may be of star form for use with a "Torx" element, and is confined within the projection of the portion 88.

Another advantageous feature of the invention is that the socket 22 and the series of wafers 24, without the inner drive elements 26, serve as a socket wrench set; the wafers themselves may be used as drivers, by applying them directly to the workpieces, i.e., bolt heads.

For convenience, and particularly in interpretation of the claims, the socket 22 and wafer 24 of FIG. 1, and the socket 66 of FIG. 10, are each and both referred to as socket means.

Figure 4:
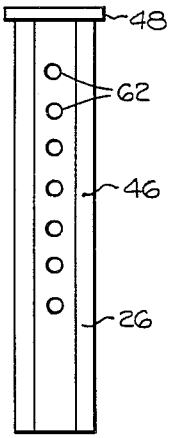
FIG. 4 is a large scale side view of the inner drive element of the unit of FIG. 1.
Figure 15:
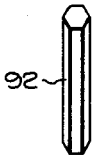
FIG. 15 shows an alternate form of inner drive element.

FIG. 15 shows an inner drive element 92 that may be utilized instead of the element 26 of FIG. 4. The element 92 is a straight hex rod without a head such as 48 and without recesses such as 62. The element 92 may be inserted in the socket from the front end as well as the rear end. In the present case the element 92 may be as convenient to use, but the invention is of sufficient scope to cover this form.

Figure 16:
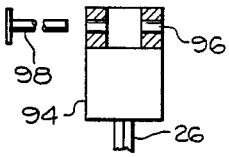
FIG. 16 shows an alternate form of socket.

The invention is of such scope, also, to cover a socket 94 of FIG. 16, which differ from that of FIG. 1. In the socket of FIG. 16, instead of the recesses 37, the present socket 94 is provided with a diametrical hole 96 for receiving a T wrench 98 of known kind. This wrench can be used for turning the socket, instead of the power tool 16, if desired, and it also serves as recesses for the same purpose as the recesses 37 of FIG. 1.

I claim:

1. A socket wrench unit comprising, a socket having a rear end and a front end, and a longitudinal hole therethrough from end to end and having means at the rear end for mounting the socket on a drive tool, said hole having a rearward facing shoulder, an inner drive element in said hole having a head engaging said shoulder and extending forwardly through said hole, and stopper means separate from the socket and the inner drive element operable for retaining the inner drive element against falling through the hole rearwardly, the stopper means being held in place in the hole by friction, and removable by imposing abnormal force rearwardly on the inner drive element.

2. A socket wrench unit according to claim 1 wherein, the stopper means is made of pliable material capable of being placed in said hole by applying force thereto longitudinally, and thereby plying the material into friction engagement with the surface of the hole.

3. A socket wrench unit according to claim 2 wherein, the hole has recesses in its side wall, and the retaining means is extended into the recesses and is thereby held positively from displacement against normal forces encountered in use.

4. A socket wrench unit according to claim 2 wherein, the retaining means is of plastic material.

5. A socket wrench element according to claim 4 wherein, the shank has a polygonal shape for operably positioning in a complementary shaped hole in a holder.

6. A socket wrench unit comprising, a socket having a rear end and a front end, and having a longitudinal hole therethrough from end to end, the socket having a rear cavity at its rear end for receiving a rotatable element of a drive tool, the socket having a front cavity at its front end, a drive element unit in the hole, including a wafer having a hole therethrough and mounted in the front cavity, and an inner drive element in the hole in the wafer and extending forwardly from the wafer and beyond the front end of the socket, means securing the wafer in the front cavity, means securing the inner drive element in the wafer, both said securing means together are constituted by a single set screw extending through a hole in the wall of the socket and a hole in the wall of the wafer and into engagement with the inner drive element, the set screw having threaded engagement in the hole in the side wall of the socket, and the hole in the side wall of the wafer being of clearance size relative to the set screw, and the hole in the side wall of the wafer having an inner portion of reduced size and non-threaded, and an outer portion of clearance size, the hole in the side wall of the socket being threaded and of a size between the sizes of the two portions of the hole in the side wall of the wafer, and the set screw having a threaded main portion threaded in the hole in the side wall of the socket and a small portion fitted snugly in said reduced inner portion of the hole in the side wall of the wafer.

7. A socket wrench unit comprising, a socket having a rear end and a front end, and having a longitudinal hole therethrough from end to end, the socket having a rear cavity at its rear end for receiving a rotatable element of a drive tool, the socket having a front cavity at its front end, a drive element unit in the hole, including a wafer having a hole therethrough and mounted in the front cavity, and an inner drive element in the hole in the wafer and extending forwardly from the wafer and beyond the front end of the socket, means securing the wafer in the front cavity, means securing the inner drive element in the wafer, the drive element unit having an inner end within the hole in the socket and an outer end that extends beyond the front end of the socket, the front cavity and the hole in the socket, at the juncture thereof, forming a forwardly facing shoulder, the wafer engaging said shoulder and the shoulder thereby limiting the rearward movement of the wafer, and the inner drive element having a head on its inner end engageable with the wafer and the wafer thereby limits the forward movement of the inner drive element.

8. A socket wrench unit according to claim 7 wherein, the socket includes a stopper preventing falling of the inner drive element rearwardly through the hole.

* * * * *